US011120759B2

(12) United States Patent
Wang

(10) Patent No.: US 11,120,759 B2
(45) Date of Patent: Sep. 14, 2021

(54) DISPLAY CONTROL APPARATUS AND DISPLAY DEVICE

(71) Applicant: HKC Corporation Limited, Shenzhen (CN)

(72) Inventor: Mingliang Wang, Shenzhen (CN)

(73) Assignee: HKC Corporation Limited, Shenzhen (CN)

( * ) Notice: Subject to any disclaimer, the term of this patent is extended or adjusted under 35 U.S.C. 154(b) by 0 days.

(21) Appl. No.: 17/044,095

(22) PCT Filed: Nov. 28, 2018

(86) PCT No.: PCT/CN2018/118002
§ 371 (c)(1),
(2) Date: Sep. 30, 2020

(87) PCT Pub. No.: WO2020/097986
PCT Pub. Date: May 22, 2020

(65) Prior Publication Data

US 2021/0035515 A1 Feb. 4, 2021

(30) Foreign Application Priority Data

Nov. 12, 2018 (CN) ..... 201811339280.3

(51) Int. Cl.
*G09G 5/00* (2006.01)
*G09G 3/36* (2006.01)

(52) U.S. Cl.
CPC ..... *G09G 3/3648* (2013.01); *G09G 3/3674* (2013.01); *G09G 3/3685* (2013.01);
(Continued)

(58) Field of Classification Search
CPC ..... G09G 3/36; G09G 3/3611; G09G 3/3648; G09G 3/3674; G09G 3/3685;
(Continued)

(56) References Cited

U.S. PATENT DOCUMENTS 6,140,985 A * 10/2000 Kanai ..... G09G 3/22 345/74.1
6,870,522 B2 * 3/2005 Sagano ..... G09G 3/22 345/75.2

(Continued)

FOREIGN PATENT DOCUMENTS

CN 1928682 A 3/2007
CN 100363969 C 1/2008

(Continued)

OTHER PUBLICATIONS

English Translation of the International Search Report dated Jul. 17, 2019, issued in corresponding International Application No. PCT/CN2018/118002, filed Nov. 28, 2018, 2 pages.

(Continued)

*Primary Examiner* — Joe H Cheng
(74) *Attorney, Agent, or Firm* — Christensen O'Connor Johnson Kindness PLLC

(57) ABSTRACT

A display control apparatus includes a data driver, a timing controller, and a control circuit. The data driver is configured to output a data signal. The timing controller includes a timing output circuit configured to output a frame start signal located at the start of a frame. The control circuit is electrically connected to the timing output circuit and to the data driver. The control circuit is configured to detect whether a frame start signal exists and to output a compensation signal according to the detection result. If the control circuit detects that a frame start signal exists, the control circuit outputs a compensation signal to the data driver.

20 Claims, 5 Drawing Sheets

(52) U.S. Cl.
CPC . *G09G 2300/0439* (2013.01); *G09G 2310/08* (2013.01); *G09G 2370/22* (2013.01)

(58) Field of Classification Search
CPC ... G09G 2300/0439; G09G 2310/0232; G09G 2310/08; G09G 2370/22
See application file for complete search history.

(56) References Cited

U.S. PATENT DOCUMENTS

| | | | | |
|---|---|---|---|---|
| 7,701,429 | B2 * | 4/2010 | Kim | G09G 3/3611 345/87 |
| 8,773,336 | B2 * | 7/2014 | Knapp | G09G 3/2003 345/82 |
| 2001/0035850 | A1 * | 11/2001 | Okamoto | G09G 3/3406 345/77 |
| 2003/0122759 | A1 * | 7/2003 | Abe | G09G 3/22 345/89 |
| 2007/0229447 | A1 * | 10/2007 | Takahara | G09G 3/3406 345/102 |
| 2017/0123582 | A1 | 5/2017 | Kim | |
| 2018/0144699 | A1 * | 5/2018 | Zeng | G09G 3/3648 |
| 2021/0110784 | A1 * | 4/2021 | Wang | G09G 3/3677 |

FOREIGN PATENT DOCUMENTS

| | | | | |
|---|---|---|---|---|
| CN | 101299324 | A | | 11/2008 |
| CN | 101452676 | A | | 6/2009 |
| CN | 101681606 | A | | 3/2010 |
| CN | 102024438 | A | | 4/2011 |
| CN | 104361876 | A | | 2/2015 |
| CN | 104503632 | A | | 4/2015 |
| CN | 104952407 | A | | 9/2015 |
| CN | 105390113 | A | | 3/2016 |
| CN | 105761690 | A | | 7/2016 |
| CN | 107742502 | A | | 2/2018 |
| CN | 107924658 | A | | 4/2018 |
| JP | 2006072211 | A | | 3/2006 |
| JP | 2007212543 | A | * | 8/2007 |
| KR | 20070077840 | A | * | 7/2007 |

OTHER PUBLICATIONS

Chinese Office Action dated Dec. 20, 2019, issued in corresponding CN Application No. 201811338831.4, filed Nov. 12, 2018, 8 pages.
Chinese Office Action dated Jul. 29, 2020, issued in corresponding CN Application No. 201811338831.4, filed Nov. 12, 2018, 9 pages.
Chinese Office Action dated Nov. 21, 2019, issued in CN Application No. 201811339280.3, filed Nov. 12, 2018, 13 pages.
Chinese Office Action dated Sep. 10, 2020, issued in CN Application No. 201811339280.3, filed Nov. 12, 2018, 17 pages.
Liao, Y.P. et al., "Thin film transistor liquid crystal display Theory and Design," Electronic Industry, Mar. 31, 2016, pp. 205-206 and pp. 225-226.

* cited by examiner

DISPLAY CONTROL APPARATUS AND DISPLAY DEVICE

This application is a national stage of PCT/CN2018/118002, filed on Nov. 28, 2018, which is based upon and claims priority to Chinese Patent Application No. 201811339280.3, filed on Nov. 12, 2018, and the entire contents thereof are incorporated herein by reference.

TECHNICAL FIELD

The present disclosure relates to the field of display technologies, and more particularly relate to a display control apparatus and a display device.

BACKGROUND

The description herein provides only background information related to the present disclosure but does not necessarily constitute the existing technology.

With the development of display technologies, various display devices enrich people's production and living. Liquid crystal display technologies have been quite mature and are constantly updated and improved. Liquid crystal display panels occupy an absolute market position, and are widely applied to the fields of displays, computers, televisions, and mobile phone screens.

In the related art, in order to avoid polarization of liquid crystal, alternating current driving is used for driving the display panel. That is, in a previous frame, a first polarity (for example, a positive polarity) voltage is used for driving, and in a next frame, a second polarity (for example, a negative polarity) voltage is used for driving. In this case, a first row of subpixels in the next frame tends to be dark in display due to insufficient charging.

SUMMARY

According to various embodiments of present disclosure, a display control apparatus and a display device are provided.

A display control apparatus includes:

a data driver, configured to output a data signal;

a timing controller, including a timing output circuit, the timing output circuit is configured to output a frame start signal, and the frame start signal is located at a beginning of a frame; and a control circuit, electrically coupled to the timing output circuit and the data driver, configured to detect whether there is the frame start signal and output a compensation signal according to a detection result;

when the control circuit detects that there is the frame start signal, the control circuit outputs the compensation signal to the data driver, so that a switching speed of the data signal when the frame start signal is detected is greater than a switching speed of the data signal when no frame start signal is detected.

In one of the embodiments, the control circuit includes a detection circuit and a compensation circuit;

the detection circuit is electrically coupled to the timing output circuit and the compensation circuit, and is configured to detect whether there is the frame start signal; and the compensation circuit is electrically coupled to the data driver, and is configured to output the compensation signal according to the detection result; and when the detection circuit detects the frame start signal, the compensation circuit outputs the compensation signal to the data driver.

In one of the embodiments, the compensation circuit includes a compensation memory and a compensation processor; and the compensation memory is configured to store a value of the compensation signal; and the compensation processor is configured to read the value of the compensation signal in the compensation memory and output the compensation signal.

In one of the embodiments, the control circuit is located in the timing controller.

In one of the embodiments, the data driver includes a basic data circuit, configured to output a basic signal;

when the control circuit detects the frame start signal, the data driver outputs the data signal according to a result of superimposing the compensation signal and the basic signal;

when the control circuit does not detect the frame start signal, the data driver outputs the data signal according to the basic signal.

In one of the embodiments, the data driver includes a basic data circuit, configured to output a basic signal;

when the control circuit detects the frame start signal, the data driver outputs the data signal according to the compensation signal;

when the control circuit does not detect the frame start signal, the data driver outputs the data signal according to the basic signal.

In one of the embodiments, the timing output circuit is further configured to output a normal signal, the normal signal is located after the frame start signal in the same frame; and a level of the frame start signal is different from a level of the normal signal.

In one of the embodiments, the display control apparatus further includes a scan driver configured to output a scanning signal, and the frame start signal and the normal signal are input signals of the scan driver.

A display control apparatus includes:

a scan driver, configured to output a scanning signal;

a data driver, configured to output a data signal;

a timing controller, including a timing output circuit, the timing output circuit is configured to output input signals of the scan driver; and the input signals of the scan driver include a frame start signal and a normal signal, the frame start signal is located at a beginning of a frame, the normal signal is located after the frame start signal in the same frame, and a level of the frame start signal is higher than a level of the normal signal; and a control circuit, located in the timing controller, electrically coupled to the timing output circuit and the data driver, and configured to detect whether there is the frame start signal and output a compensation signal according to a detection result;

when the control circuit detects the frame start signal, the control circuit outputs the compensation signal to the data driver, so that a switching speed of the data signal when the frame start signal is detected is greater than a switching speed of the data signal when no frame start signal is detected.

A display device includes a display control apparatus and a display panel, the display control apparatus includes a data driver, configured to output a data signal;

a timing controller, including a timing output circuit, the timing output circuit is configured to output a frame start signal, and the frame start signal is located at a beginning of a frame; and a control circuit, electrically coupled to the timing output circuit and the data driver, and configured to detect whether there is the frame start signal and output a compensation signal according to a detection result;

when the control circuit detects that there is the frame start signal, the control circuit outputs the compensation signal to the data driver, so that a switching speed of the data signal when the frame start signal is detected is greater than a switching speed of the data signal when no frame start signal is detected; and the display panel includes a plurality of rows of subpixels and a plurality of data lines, and the data lines are electrically coupled to the data driver and the subpixels.

The details of one or more embodiments of the disclosed subject matter are set forth in the accompanying drawings and the description below. Other features, objects, and advantages of the disclosure will be apparent from the description and drawings, and from the claims.

DESCRIPTION OF THE DRAWINGS

To better describe and illustrate embodiments or examples of the subject matter disclosed herein, reference may be made to one or more drawings. The additional details or examples used to describe the drawings are not to be construed as limiting the scope of the disclosure.

DETAILED DESCRIPTION

To make the objectives, technical solutions, and advantages of the present disclosure clearer and more comprehensible, the following further describes the present disclosure in detail with reference to the accompanying drawings and embodiments. It should be understood that the specific embodiments described herein are merely used to explain the present disclosure but are not intended to limit the present disclosure.

A display control apparatus provided in the present disclosure may be, but not limited to being applied to liquid crystal display devices (for example, a liquid crystal computer, a liquid crystal television, and a liquid crystal mobile phone screen).

Figure 1:
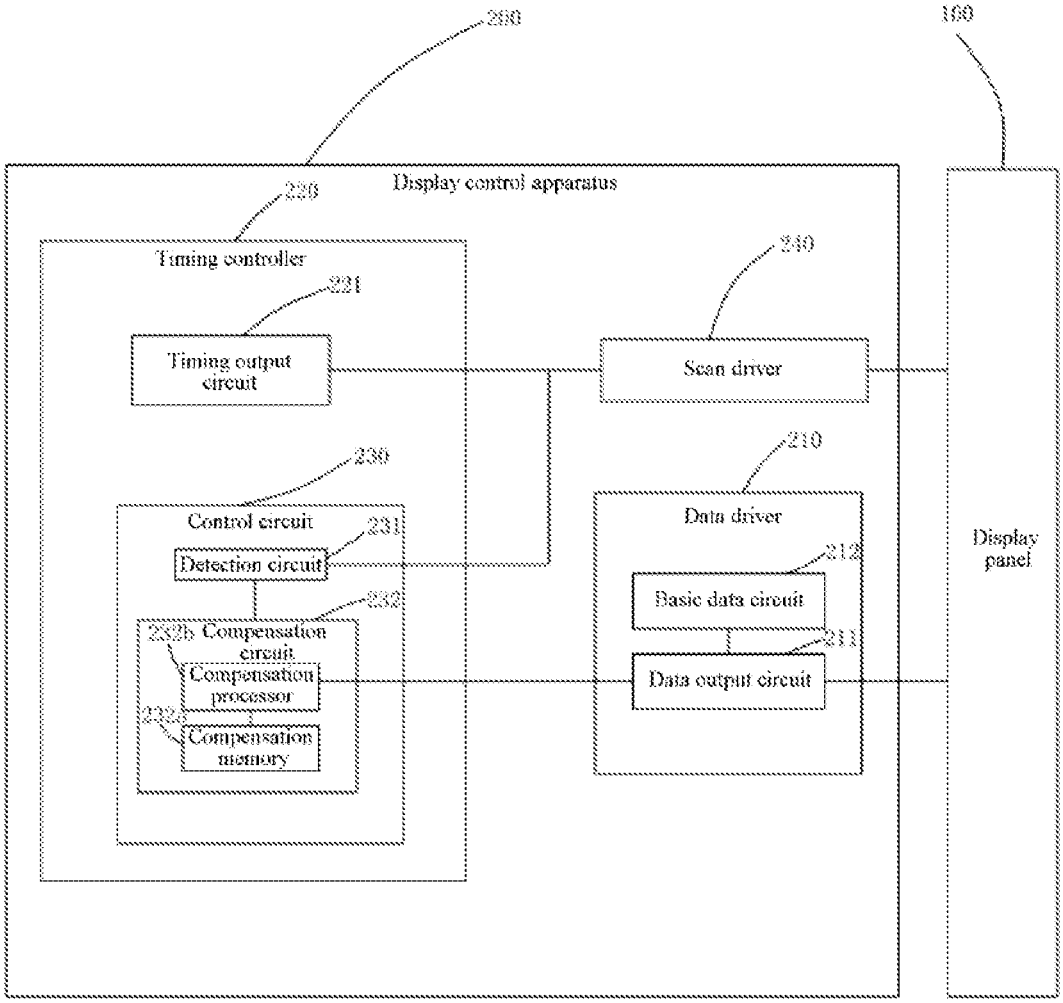
FIG. 1 is a schematic view of a display device according to an embodiment of the present disclosure.
Figure 2:
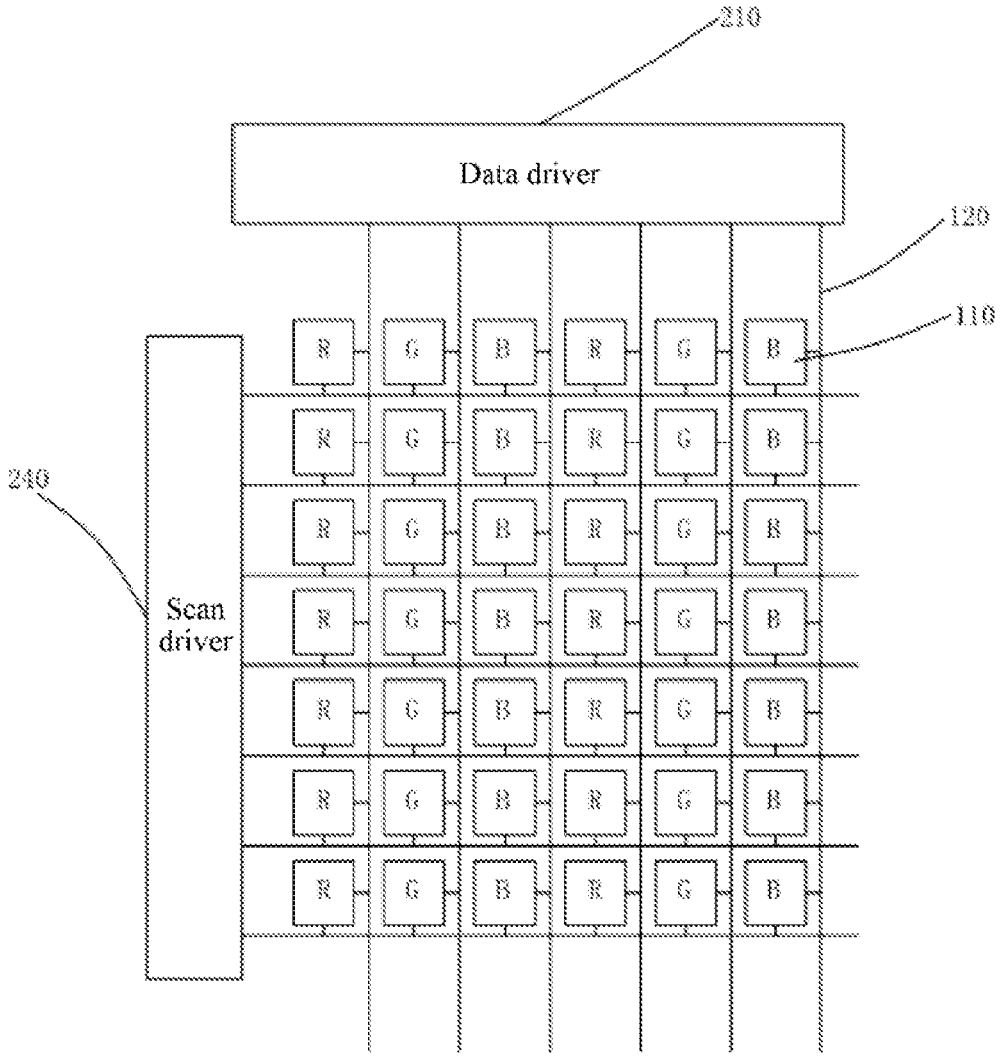
FIG. 2 is a partial schematic view of a display device according to an embodiment of the present disclosure.

Referring to FIG. 1 and FIG. 2, in an embodiment, a display device is provided. The display device includes a display panel 100 and a display control apparatus 200. The display panel 100 includes a plurality of rows of subpixels 110 and a plurality of data lines 120. The data lines 120 are electrically coupled to the display control apparatus and the subpixels 110, to charge each row of subpixels 110.

Specifically, referring to FIG. 2, the display panel 100 may include a plurality of different colors of subpixels 110, for example, a red subpixel R, a green subpixel G, and a blue subpixel B. The plurality of different colors of subpixels 110 may form a display circuit. The different colors of subpixels 110 in the display circuit cooperate with each other, so that the display circuit may display any required color. In addition, all the subpixels 110 of the display panel are sequentially arranged in a plurality of rows, and in each row, there is a plurality of subpixels 110. When the display panel works, the subpixels 110 are switched on row by row. The subpixel 110 may include a pixel electrode, a common electrode, and liquid crystal molecules between the two electrodes. When each row of subpixels 110 is switched on, the data lines 120 charge a pixel electrode of each subpixel 110, so that liquid crystal molecules deflect and are translucently displayed.

The display control apparatus 200 is coupled to the data lines 120, so as to provide data signals to the data lines 120. Referring to FIG. 1, the display control apparatus 200 specifically includes a data driver 210 and a timing controller 220.

The data driver 210 may include a data output circuit 211. The data output circuit 211 is configured to output data signals to the data lines 120. To avoid polarization of liquid crystal, the data signals are in a form of alternating currents. That is, when the display device works, polarities of the data signals output by the data output circuit 211 to a same data line 120 in a previous frame and a next frame are different. There is an idle time between the previous frame and the next frame. In the idle time, the data output circuit 211 does not output a data signal, and a level a of the last drive voltage across a drive line (a line connecting the data output circuit 211 and the data line 120) of the display device in the previous frame is maintained.

Figure 3:
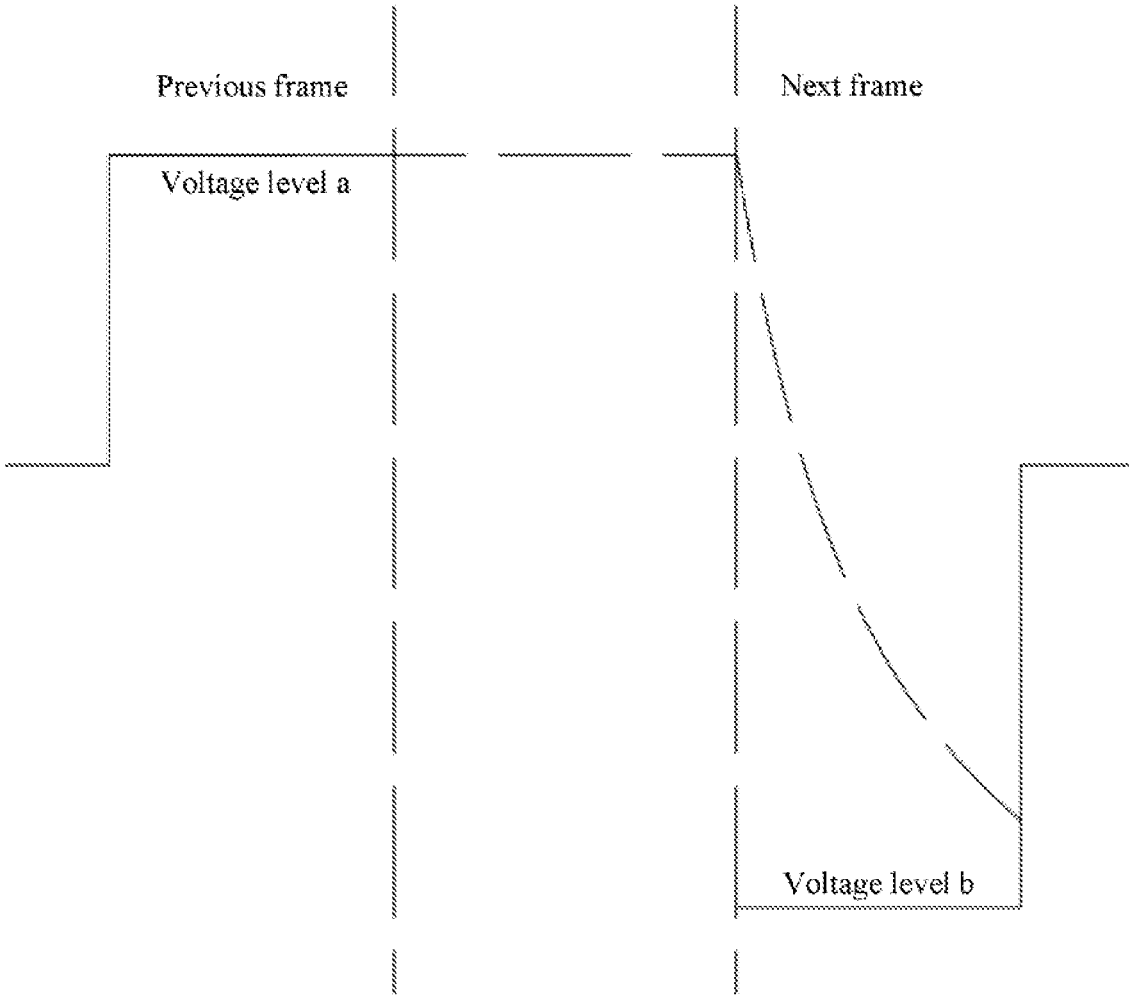
FIG. 3 is a sequence diagram of a data signal of an exemplary display device.

As shown in FIG. 3, in a display device as an example, when the data output circuit 211 outputs a data signal to a same data line 120 in the next frame, a voltage across the drive line starts to switch from the level a. It is assumed that a level of a target charging voltage to which the data line is switched is a level b that has a polarity opposite to that of the level a. Due to opposite polarities, there is a large difference between the voltage at the level a and the voltage at the level b, and consequently, a level of an actual charging voltage at which a first row of subpixels 110 start to be charged is easily lower than the level b of the target charging voltage. After the first row, when the data output circuit 211 charges other rows of subpixels 110 in the same frame, because a polarity of the data signal does not change, a level of an actual charging voltage of the other rows may easily reach the target charging voltage. Consequently, relative to the other rows of subpixels 110, the first row of subpixels 110 is relatively dark.

In the embodiment of the present disclosure, referring to FIG. 1, the timing controller 220 includes a timing output circuit 221. The timing output circuit 221 is configured to output a frame start signal $V_{S1}$. The frame start signal $V_{S1}$ is located at a beginning of a frame.

In addition, the display control apparatus 200 in the embodiment of the present disclosure further includes a control circuit 230. The control circuit 230 is electrically coupled to the timing output circuit 221 and the data driver 210. When the display device works, the control circuit 230 is configured to: detect whether there is the frame start signal $V_{S1}$ and output a compensation signal according to a detection result.

Specifically, when the control circuit 230 detects that there is the frame start signal $V_{S1}$, the control circuit outputs the compensation signal to the data driver 210, so that a switching speed of the data signal when the frame start signal $V_{S1}$ is detected is greater than a switching speed of the data signal when no frame start signal $V_{S1}$ is detected. A setting of the data signal when no frame start signal $V_{S1}$ is detected may be the same as a setting of the data signal in the display device as an example.

Figure 4:
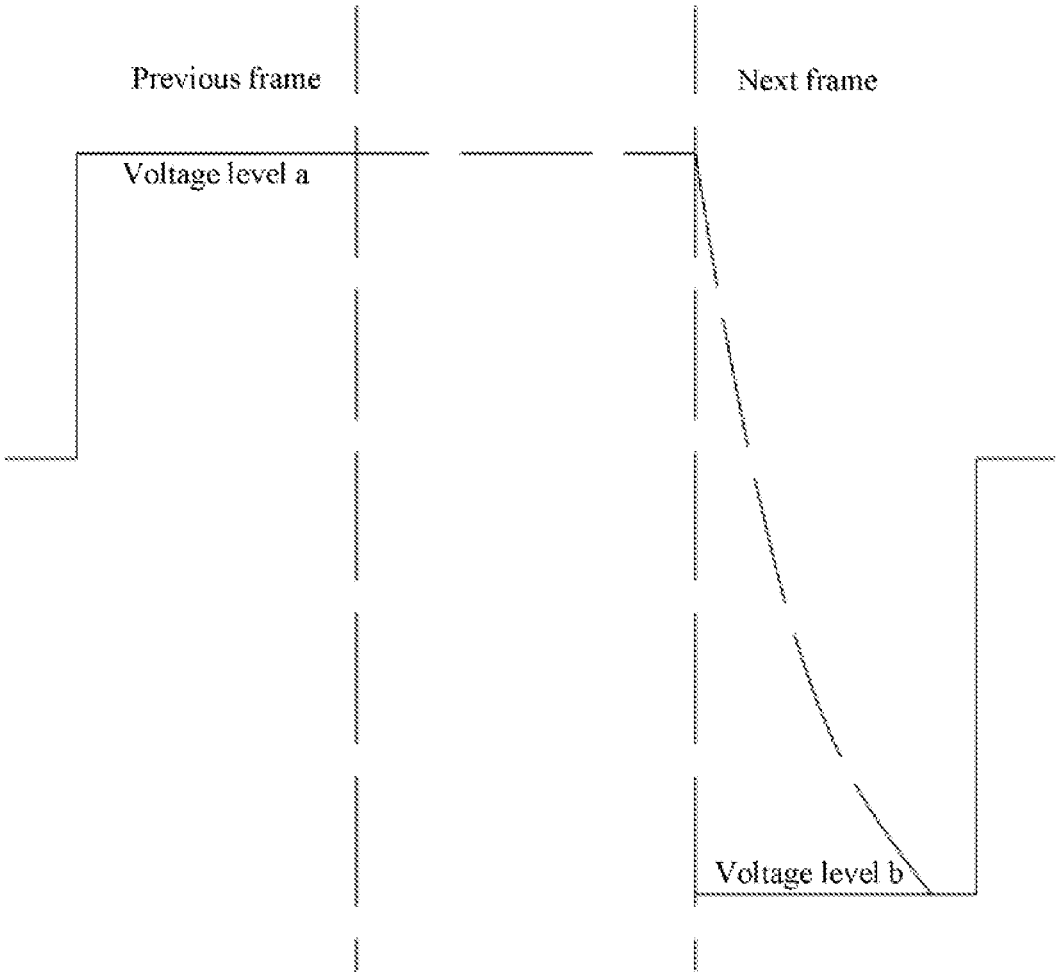
FIG. 4 is a sequence diagram of a data signal according to an embodiment of the present disclosure.

The frame start signal $V_{S1}$ is located at the beginning of the frame. Referring to FIG. 4, when it is detected that there is the frame start signal $V_{S1}$, that is, when the frame starts, the control circuit outputs the compensation signal to the data driver 210, so that an input voltage of the data driver 210 may be greater than an input voltage of the data driver 210 in the display device as an example. As the input voltage increases, a voltage difference between the data driver 210 and the data line 120 may increase. However, a line impedance between the two is unchanged, and therefore, an output current of the data driver 210 increases. As the output current increases, a charge transmission speed increases, and the switching speed of the data signal output by the data driver 210 to the data line 120 increases. Therefore, the first row of subpixels 110 charged in a start phase of a next frame can be charged to a specified target charging voltage in a short time by using a relatively high switching speed of the data signal when there is the frame start signal, thereby effectively improving a problem that the first row is in dark display.

Still referring to FIG. 1, in an embodiment, for the ease of design implementation, the control circuit 230 specifically includes a detection circuit 231 and a compensation circuit 232. The detection circuit 231 is electrically coupled to the timing output circuit 221. Therefore, the detection circuit 231 may detect whether the timing output circuit 221 outputs a frame start signal $V_{S1}$, that is, whether there is the frame start signal $V_{S1}$. The detection circuit 231 is further electrically coupled to a compensation circuit 232, so that the compensation circuit 232 can output a compensation signal according to a detection result. The compensation circuit 232 is electrically coupled to the data driver 210, so as to output the compensation signal to the data driver 210 when the detection circuit 231 detects the frame start signal $V_{S1}$.

In an embodiment, the compensation circuit 232 includes a compensation memory 232*a* and a compensation processor 232*b*. The compensation memory 232*a* is configured to store a value of the compensation signal. The value of the compensation signal may be verified through experiments and prestored in the compensation memory 232*a*. When the detection circuit 231 detects the frame start signal $V_{S1}$, the compensation processor 232*b* is configured to: read the value of the compensation signal stored in the memory 232*a* and output the compensation signal according to the value. The compensation memory 232*a* is located in the timing controller 220. Specifically, the compensation memory 232*a* may be an original memory in the timing controller 220, so that a circuit structure is simplified. Certainly, the compensation memory 232*a* may be a memory additionally added to the timing controller 220, or the compensation memory 232*a* may be located at another position.

In an embodiment, further, the compensation circuit 232 is disposed in the timing controller 220, that is, both the compensation memory 232*a* and the compensation processor 232*b* are located in the timing controller 220, so that it is convenient for the compensation processor 232*b* to read the value of the compensation signal stored in the memory 232*a*.

In this case, furthermore, if the control circuit 230 is entirely disposed in the timing controller 220, that is, both the compensation circuit 232 and the detection circuit 231 are disposed in the timing controller 220, provided that a set of input/output ports is added to the timing controller 220 of the original display device, the set of input/output ports can easily pull back the frame start signal $V_{S1}$ output by the timing controller 220 into the timing controller 220 for detection and send the compensation signal.

Certainly, it is not limited that the control circuit 230 is located in the timing controller 220, and the control circuit 230 may be located at another position (for example, in the data driver 210 or a scan driver 240). This is not limited in the present disclosure.

In an embodiment, the data driver 210 includes a basic data circuit 212. The basic data circuit 212 is configured to output a basic signal to the data output circuit 211. The basic signal may be an input signal the same as the input signal provided by the display device as an example to the data output circuit 211 to output the data signal. When the control circuit 230 detects the frame start signal $V_{S1}$, both the basic signal output by the basic data circuit 212 and compensation data output by the compensation circuit 232 are output to the data output circuit 211. The data output circuit 211 is configured to directly output a data signal. Therefore, the data driver outputs the data signal according to a result of superimposing the compensation signal and the basic signal. When the control circuit 230 does not detect the frame start signal $V_{S1}$, only the basic signal output by the basic data circuit 212 is output to the data output circuit 211, and therefore, the data driver 210 outputs the data signal according to the basic signal.

In the foregoing embodiment, the compensation signal is a compensation difference signal. Certainly, in the present disclosure, the compensation signal may be in a compensation form different from above. In another embodiment, the compensation signal is a compensation full value signal. A value of the compensation full value signal is equal to a sum of a value of the compensation difference signal and a value of the basic signal. Specifically, when the control circuit 230 detects the frame start signal $V_{S1}$, only the compensation data output by the compensation circuit 232 is output to the data output circuit 211. Therefore, the data driver outputs the data signal according to the compensation signal. When the control circuit 230 does not detect the frame start signal $V_{S1}$, only the basic signal output by the basic data circuit 212 is output to the data output circuit 211, and therefore, the data driver 210 outputs the data signal according to the basic signal.

The two different compensation forms in the two embodiments described above enrich an application form of the display control apparatus 200, so that the display control apparatus 200 can more flexibly output the data signal according to different requirements and conditions.

Figure 5:
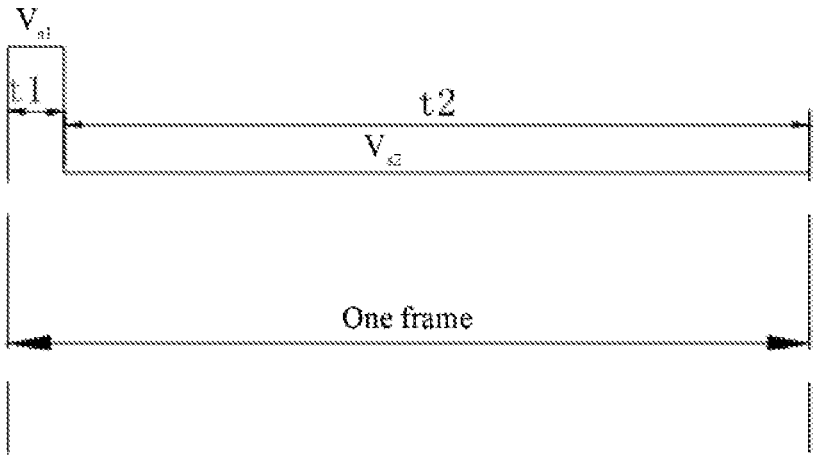
FIG. 5 is a sequence diagram of a data control signal in a frame according to an embodiment of the present disclosure.

In an embodiment, the timing controller 220 is further configured to output a normal signal $V_{S2}$. The normal signal $V_{S2}$ is located after the frame start signal $V_{S1}$ in the same frame. Referring to FIG. 5, FIG. 5 is a sequence diagram of a data control signal in a complete frame. The frame start signal $V_{S1}$ is located at a beginning of a frame and has duration t1. The normal signal $V_{S2}$ is located after the frame start signal in the same frame and has duration t2.

A level of the frame start signal $V_{S1}$ is different from a level of the normal signal $V_{S2}$, and therefore, the frame start signal $V_{S1}$ used as an input signal of the scan driver 240 is identifiable and can be detected and identified. Specifically, the level of the frame start signal $V_{S1}$ may be lower than the level of the normal signal $V_{S2}$. In this case, to reduce energy consumption, it may be further set that t1 is greater than t2.

In addition, it may be set that the level of the frame start signal $V_{S1}$ is higher than the level of the normal signal $V_{S2}$. In this case, to reduce energy consumption, it may be further set that t1 is less than t2. Because the frame start signal $V_{S1}$ determines whether the compensation circuit 232 outputs the compensation signal, and duration required for outputting the compensation signal is generally close to duration of a row of scanning signals and far less than duration of a frame, a setting that t1 is less than t2 more satisfies requirements on this aspect comparatively.

In an embodiment, the display control apparatus 200 further includes a scan driver 240 configured to output a scanning signal. Both the frame start signal $V_{S1}$ having a high level and short duration and the normal signal $V_{S2}$ having a low level and long duration are input signals of the scan driver 240. After the input signals of the scan driver 240 are input to the scan driver 240, the scan driver 240 outputs a scanning signal to a subpixel to switch on the subpixel. The frame start signal $V_{S1}$ and the normal signal $V_{S2}$ are set as the input signals of the scan driver 240, so that the input signals of the scan driver 240 of the display control apparatus are multifunctional, and an output circuit structure of the display control apparatus 200 is simplified, thereby reducing energy consumption of the display control apparatus.

Certainly, in the embodiment of the present disclosure, the frame start signal $V_{S1}$ may not be the input signal of the scan driver 240 and is otherwise designed. This is not limited in the present disclosure.

In an embodiment, still referring to FIG. 5, it is set that t1 is less than t2. Specifically, t1 is scanning duration of the first row of subpixels in a frame (that is, duration of a first row of scanning signals of the scan driver in a frame). t2 is a sum of scanning duration of a second row of subpixels and scanning duration of all rows of subpixels following the second row (that is, a sum of duration of a second row of scanning signals and all rows of scanning signals following the second row of the scan driver in a frame).

t1 is the scanning duration of the first row of subpixels in the frame. In other words, the duration t1 of the frame start signal $V_{S1}$ at a high level is equal to duration of a row of scanning signals of the scan driver 240 and is also equal to charging duration of the first row of subpixels 110. Therefore, it can be ensured that the first row of subpixels 110 can have a sufficiently fast voltage switching speed in a whole scanning period of the row, so as to be fully charged. In addition, high level signals are not wasted in the second row of subpixels 110 and the other rows of subpixels 110 following the second row that are originally fully charged, thereby reducing energy consumption.

In an embodiment, the display control apparatus 200 includes a scan driver 240, a data driver 210, and a timing controller 220. The scan driver 240 is configured to output a scanning signal. The data driver 210 includes a data output circuit 211 and a basic data circuit 212. The data output circuit 211 is configured to output a data signal. The basic data circuit 212 is configured to output a basic signal.

The timing controller 220 includes a timing output circuit 221 and a control circuit 230. The timing output circuit 221 is configured to output input signals of the scan driver 240. The input signals of the scan driver 240 include a frame start signal $V_{S1}$ and a normal signal $V_{S2}$. The frame start signal $V_{S1}$ is located at a beginning of a frame, and the normal signal $V_{S2}$ is located after the frame start signal in the same frame. A level of the frame start signal $V_{S1}$ is higher than a level of the normal signal $V_{S2}$, so that the frame start signal $V_{S1}$ can be detected and identified.

The control circuit 230 is located in the timing controller and electrically coupled to the timing output circuit 221, so as to detect whether there is the frame start signal $V_{S1}$. In addition, the control circuit 230 is electrically coupled to the data driver 210, so as to output a compensation signal to the data driver 210 when the frame start signal $V_{S1}$ is detected.

The basic data circuit 212 outputs the basic signal, and when the control circuit 230 does not detect the frame start signal $V_{S1}$, the data driver 210 outputs the data signal according to the basic signal only.

The compensation signal may be a compensation different signal. In this case, when the control circuit 230 detects the frame start signal $V_{S1}$, the data driver 210 outputs the data signal according to a result of superimposing the basic signal and the compensation signal. The compensation signal makes a voltage compensation based on the basic signal, so that a switching speed of the data signal when the frame start signal $V_{S1}$ is detected is greater than a switching speed of the data signal when no frame start signal $V_{S1}$ is detected. Therefore, a first row of subpixels 110 charged in a start phase of a frame can be charged to a specified target charging voltage in a short time by using a relatively high switching speed of the data signal when there is the frame start signal $V_{S1}$, thereby effectively improving a problem that the first row is in dark display.

Certainly, the compensation signal may be a compensation full value signal. A value of the compensation full value signal is equal to a sum of a value of the compensation difference signal and a value of the basic signal. In this case, when the control circuit 230 detects the frame start signal $V_{S1}$, the data driver 210 outputs the data signal according to the compensation signal only, so that a switching speed of the data signal when the frame start signal $V_{S1}$ is detected can also be greater than a switching speed of the data signal when no frame start signal $V_{S1}$ is detected, thereby effective improving a problem that the first row is in dark display.

In conclusion, according to the display control apparatus provided in the present disclosure, when the control circuit detects the frame start signal, the control circuit outputs the compensation signal to the data driver, so that the switching speed of the data signal when the frame start signal is detected is greater than the switching speed of the data signal when no frame start signal is detected. The frame start signal is located at a beginning of a frame. Therefore, the first row of subpixels charged in a start phase of a frame can be charged to a specified target charging voltage in a short time by using a relatively high switching speed of the data signal when there is the frame start signal, thereby effectively improving a problem that the first row is in dark display.

Technical features of the foregoing embodiments may be randomly combined. For the brevity of description, not all possible combinations of the technical features in the foregoing embodiments are described. However, as long as combinations of these technical features do not contradict each other, it should be considered that the combinations all fall within the scope of this specification.

The foregoing embodiments only describe exemplary implementations of the present disclosure, which are described specifically and in detail, and therefore cannot be construed as a limitation to the scope of the claimed subject matter. It should be noted that, a person of ordinary skill in the art may make various changes and improvements without departing from the ideas of the present disclosure, which shall all fall within the protection scope of the present disclosure. Therefore, the protection scope of the patent of the present disclosure shall be subject to the appended claims.

What is claimed is:

1. A display control apparatus, comprising:

a data driver configured to output a data signal;

a timing controller comprising a timing output circuit, wherein the timing output circuit is configured to output a frame start signal, and the frame start signal is located at a beginning of a frame; and a control circuit, electrically coupled to the timing output circuit and the data driver, configured to detect whether there is the frame start signal and output a compensation signal according to a detection result, wherein when the control circuit detects the frame start signal, the control circuit outputs the compensation signal to the data driver so that a switching speed of the data signal when the frame start signal is detected is greater than a switching speed of the data signal when no frame start signal is detected.

2. The display control apparatus according to claim 1, wherein:

the control circuit comprises a detection circuit and a compensation circuit;

the detection circuit is electrically coupled to the timing output circuit and to the compensation circuit and is configured to detect whether there is the frame start signal; and the compensation circuit is electrically coupled to the data driver and is configured to output the compensation signal according to the detection result; and when the detection circuit detects the frame start signal, the compensation circuit outputs the compensation signal to the data driver.

3. The display control apparatus according to claim 2, wherein the compensation circuit comprises a compensation memory and a compensation processor; and the compensation memory is configured to store a value of the compensation signal; and the compensation processor is configured to read the value of the compensation signal in the compensation memory and output the compensation signal.

4. The display control apparatus according to claim 3, wherein the compensation memory is located in the timing controller.

5. The display control apparatus according to claim 4, wherein the compensation memory is an original memory in the timing controller.

6. The display control apparatus according to claim 3, wherein the compensation circuit is located in the timing controller.

7. The display control apparatus according to claim 3, wherein the control circuit is located in the timing controller.

8. The display control apparatus according to claim 3, wherein the control circuit is located in the data driver.

9. The display control apparatus according to claim 1, wherein:

the data driver comprises a basic data circuit, configured to output a basic signal;

when the control circuit detects the frame start signal, the data driver outputs the data signal according to a result of superimposing the compensation signal and the basic signal; and when the control circuit does not detect the frame start signal, the data driver outputs the data signal according to the basic signal.

10. The display control apparatus according to claim 1, wherein the data driver comprises a basic data circuit configured to output a basic signal, wherein when the control circuit detects the frame start signal, the data driver outputs the data signal according to the compensation signal; and when the control circuit does not detect the frame start signal, the data driver outputs the data signal according to the basic signal.

11. The display control apparatus according to claim 1, wherein the timing output circuit is further configured to output a normal signal, the normal signal is located after the frame start signal in the same frame; and a level of the frame start signal is different from a level of the normal signal.

12. The display control apparatus according to claim 11, wherein the level of the frame start signal is lower than the level of the normal signal.

13. The display control apparatus according to claim 12, wherein a duration of the frame start signal is greater than a duration of the normal signal.

14. The display control apparatus according to claim 11, wherein the level of the frame start signal is higher than the level of the normal signal.

15. The display control apparatus according to claim 14, wherein a duration of the frame start signal is less than a duration of the normal signal.

16. The display control apparatus according to claim 15, wherein the display control apparatus further comprises a scan driver configured to output a scanning signal, and the frame start signal and the normal signal are input signals of the scan driver.

17. The display control apparatus according to claim 16, wherein the duration of the frame start signal is a duration of a first row of scanning signals of the scan driver in a frame.

18. The display control apparatus according to claim 17, wherein the duration of the normal signal is a sum of durations of a second row of scanning signals and all rows of scanning signals following the second row of the scan driver in the frame.

19. A display control apparatus, comprising:

a scan driver configured to output a scanning signal;

a data driver configured to output a data signal;

a timing controller comprising a timing output circuit, wherein the timing output circuit is configured to output input signals of the scan driver; and the input signals of the scan driver comprise a frame start signal and a normal signal, the frame start signal is located at a beginning of a frame, the normal signal is located after the frame start signal in the same frame, and a level of the frame start signal is higher than a level of the normal signal; and a control circuit located in the timing controller and electrically coupled to the timing output circuit and to the data driver, the control circuit being configured to detect whether there is the frame start signal and output a compensation signal according to a detection result, wherein when the control circuit detects the frame start signal, the control circuit outputs the compensation signal to the data driver so that a switching speed of the data signal when the frame start signal is detected is greater than a switching speed of the data signal when no frame start signal is detected.

20. A display device, comprising a display control apparatus and a display panel, wherein the display control apparatus comprises:

a data driver configured to output a data signal;

a timing controller comprising a timing output circuit, wherein the timing output circuit is configured to output a frame start signal, and the frame start signal is located at a beginning of a frame; and a control circuit electrically coupled to the timing output circuit and to the data driver, the control circuit being configured to detect whether there is the frame start signal and to output a compensation signal according to a detection result, wherein when the control circuit detects that there is the frame start signal, the control circuit outputs the compensation signal to the data driver so that a switching speed of the data signal when the frame start signal is detected is greater than a switching speed of the data signal when no frame start signal is detected; and the display panel comprises a plurality of rows of subpixels and a plurality of data lines, and the data lines are electrically coupled to the data driver and the subpixels.

* * * * *